US007559168B2

(12) United States Patent
Wisecup et al.

(10) Patent No.: US 7,559,168 B2
(45) Date of Patent: Jul. 14, 2009

(54) SCOPE AND ACTION COVER FOR HAND GUNS AND RIFLES

(75) Inventors: Lloyd M. Wisecup, Sekiu, WA (US); Dan G. Fuller, Sequim, WA (US)

(73) Assignee: Middlepoint Trading Company, LLC, Selku, WA (US)

( * ) Notice: Subject to any disclaimer, the term of this patent is extended or adjusted under 35 U.S.C. 154(b) by 526 days.

(21) Appl. No.: 11/361,333

(22) Filed: Feb. 24, 2006

(65) Prior Publication Data

US 2006/0191184 A1 Aug. 31, 2006

Related U.S. Application Data

(60) Provisional application No. 60/657,316, filed on Feb. 28, 2005.

(51) Int. Cl.
*F41A 35/02* (2006.01)

(52) U.S. Cl. ..... 42/96; 206/317; 150/154

(58) Field of Classification Search ..... 42/96, 42/90; 206/317; 2/171, 171.04; 150/154–168
See application file for complete search history.

(56) References Cited

U.S. PATENT DOCUMENTS

| | | | | |
|---|---|---|---|---|
| 35,456 | A | 6/1862 | Leverich | |
| 2,364,340 | A | 12/1944 | Bogg, Jr. | |
| 2,404,736 | A | 7/1946 | Marick | |
| 2,462,258 | A * | 2/1949 | Dannenberg | 2/195.5 |
| 2,599,689 | A * | 6/1952 | Brelsford | 42/96 |
| 2,798,877 | A * | 7/1957 | Viard | 549/11 |
| 2,839,757 | A * | 6/1958 | Gianola | 2/205 |
| 2,872,960 | A | 2/1959 | Kolpin | |
| 2,897,510 | A * | 8/1959 | Forbes-Robinson | 2/172 |
| 2,932,334 | A * | 4/1960 | Steen | 206/317 |
| 3,015,104 | A * | 1/1962 | Crosson et al. | 2/171 |
| 3,742,635 | A | 7/1973 | Hutto | |
| 3,865,109 | A * | 2/1975 | Elmore et al. | 604/339 |
| 3,958,484 | A * | 5/1976 | Nelson et al. | 84/380 R |
| 4,180,868 | A * | 1/1980 | Snow | 2/203 |
| 4,257,464 | A | 3/1981 | Binney | |
| 4,356,831 | A * | 11/1982 | Adams | 150/167 |
| 4,593,417 | A * | 6/1986 | Brown et al. | 2/172 |
| 4,597,757 | A * | 7/1986 | Ruderian | 604/291 |
| D296,031 | S * | 6/1988 | Coy et al. | D2/866 |

(Continued)

*Primary Examiner*—Michael Carone
*Assistant Examiner*—Jonathan C Weber
(74) *Attorney, Agent, or Firm*—Jacques M. Dulin, Esq.; Innovation Law Group, Ltd.

(57) ABSTRACT

Gun scope and action cover comprises a water-proof, breathable/air-permeable, reversible, light-weight, highly-flexible fabric pouch formed by an enclosed, cinchable elastic cord that fits over the optical scope of a rifle or hand gun, and that is universal in size, quiet in use, easy to put on and take off, and easy to store. The pouch area, formed by cinching and locking the cord, is bounded with an extended skirt that drapes down over the mechanical action of the gun. 2-ply waterproof/breathable fabric is preferred. Additional features include a securing cord for adding camouflaging ghillie strips, hook and loop fastener silencer(s) that prevent accidental adhesion to clothing, the release of which causes game-spooking sound, and a pocket for a warmer unit. The cover employs a variety of camouflage patterns on one or both sides, or one side may be a dark, a light, or a safety color, such as neon orange.

20 Claims, 6 Drawing Sheets

U.S. PATENT DOCUMENTS 4,761,324 A * 8/1988 Rautenberg et al. ..... 428/198
4,858,361 A * 8/1989 White ..... 42/96
4,860,479 A * 8/1989 Easter ..... 42/96
5,048,217 A * 9/1991 Easter ..... 42/96
D323,372 S 1/1992 Heckerman
5,109,548 A * 5/1992 Balaban et al. ..... 2/173
5,150,528 A 9/1992 Shire
5,159,720 A * 11/1992 Scott, Jr. ..... 2/171
5,183,953 A * 2/1993 Anderson et al. ..... 42/96
5,214,804 A * 6/1993 Carey et al. ..... 2/206
5,251,336 A * 10/1993 Nevins ..... 2/202
5,265,365 A 11/1993 Finn
5,459,881 A * 10/1995 Fagan et al. ..... 2/209.13
5,551,087 A * 9/1996 Blutstein et al. ..... 2/173
5,575,009 A * 11/1996 Ryvin ..... 2/173
5,661,920 A 9/1997 Evans
5,664,261 A * 9/1997 Lacy ..... 2/172
5,678,344 A 10/1997 Jones et al.
5,694,648 A * 12/1997 Nucifora ..... 2/172
5,822,800 A * 10/1998 Anderson ..... 2/202
5,839,432 A * 11/1998 Daneshvar ..... 128/201.25
5,850,706 A 12/1998 Evans
D423,629 S 4/2000 Granger
6,119,388 A 9/2000 Jones et al.
6,164,003 A 12/2000 Miller
6,230,330 B1 * 5/2001 Steffy ..... 2/175.1
D445,475 S 7/2001 Spear
6,256,922 B1 7/2001 Jones et al.
6,260,204 B1 * 7/2001 Morrissey ..... 2/172
6,260,206 B1 * 7/2001 MacDonald et al. ..... 2/181
6,442,763 B1 * 9/2002 Larson et al. ..... 2/202
7,076,810 B1 * 7/2006 Rossini ..... 2/171.1
7,240,372 B2 * 7/2007 Larson ..... 2/173

* cited by examiner

SCOPE AND ACTION COVER FOR HAND GUNS AND RIFLES

CROSS REFERENCE TO RELATED APPLICATIONS

This application is related to Provisional Application Ser. No. 60/657,316 filed on Feb. 28, 2005 under the title Scope and Action Cover for Hand Guns and Rifles, the priority of which is claimed under 35 US Code §§ 119 and 120, and the entire subject matter of which is hereby incorporated by reference.

FIELD

The invention relates to protective devices for firearms, more particularly, protection of the optical scope and/or action mechanisms of hand guns, rifles or other long guns from weather-related conditions which might impair functionality.

BACKGROUND

For over a hundred years, methods have been devised for protecting guns from the elements, to keep their action mechanisms in good working order at a moment's notice. Leverich's 1862 "Improvement in Covers for Gun-Locks" (U.S. Pat. No. 35,456) utilized a tube of India-rubber fabric secured by elastic banded ends to retard the development of rust on the action. Other concerns in the early days included keeping gunpowder dry. While those problems have largely been resolved by advances in metallurgy and cartridge technology, the issues of protection from the weather has remained in the modern era, in part due to the addition of scopes and improvements in precision machining of actions, the function of both of which can be diminished by adverse weather conditions, even if less frequent or less harsh.

Sportsmen shoot during hunting season under conditions of rain, shine, snow, sleet, fog, dirt and dust. Similar conditions apply to law enforcement, national guard, security personnel and military arms bearers. But it is difficult if not impossible to see through an optical scope that is streaked with rainwater or covered with condensation or ice. Several patents issued between the 1940s and the present, including: Bogg U.S. Pat. No. 2,364,340; Brelsford U.S. Pat. No. 2,599,689; Easter U.S. Pat. Nos. 4,860,479 and 5,048,217; Jones et al U.S. Pat. Nos. 5,678,344, 6,119,388 and 6,256,922; and White U.S. Pat. No. 4,858,361 attempt to solve such problems, using rigid and soft-sided materials, zippers, drawstrings, magnets, clips and hook-and-loop fasteners to secure a cover assembly to the weapon. Typically, these were dedicated to a particular gun size and configuration; i.e. they lacked universality.

Further, and equally important, such gun and/or scope cover devices ignored one of the key issues in hunting: silence. Deer and other game have acute hearing. The sound of a snap being un-snapped, or a buckle or hook and loop fastener being released, or a hard cover dragging on branches as the hunter moves through brush is enough to spook the game. These references do not address noise suppression or avoidance.

Thus, none of these prior art covers provide the essential features most important to the sportsman—a universal cover which keeps the scope and action dry and haze-free without hindering access, and which can be quickly and quietly removed and emplaced with one hand while holding the gun in the other.

Accordingly, there is an unmet need in the art for a universal, quick-release and emplacement (on-off), form-fitting, quiet, condensation, abrasion and precipitation-resistant protective covering for rifle and hand gun scopes and actions.

THE INVENTION

Summary, Including Objects and Advantages

The inventive gun scope and action cover comprises a waterproof/breathable, abrasion resistant, reversible, lightweight, fabric pouch, formed by a cinchable elastic cord that is disposed between two mating sheets of fabric. The pouch formed by cinching the cord fits over the optical scope of a rifle or hand gun, and is bounded with an extended skirt that drapes down over the mechanical action of the gun. The inventive cover is universal in size, quiet in use, easy to put on and take off, and easy to store. The fabric is highly flexible, with good drape characteristics.

Optional or additional significant features include use of different camouflage patterns and colors on the two fabric sheets, a retaining cord or strip for added ghillie strips for camouflage, a hook and loop silencer so that there is no chance for accidental adhesion to clothing, the release of which causes game-spooking sounds, and a pocket for a warmer device to help prevent condensation on optical and metal surfaces. The cover employs a variety of camouflage patterns on one or both sides, or one side may be black or a safety color, such as neon orange.

In a first embodiment of the inventive universal scope and action cover for a gun, a pattern piece of a suitable geometric shape, cut from at least one layer of fabric, is formed into a protective pouch that fits over the scope by cinching a cord, preferably elasticized, with a cord lock. The cord is retained in an elongated, generally oval-shaped, single-fold or double-fold casing. In the simplest form, the cover is a single layer or sheet of fabric to which a casing is stitched, shaped in an oval to define a central pouch area. The area between the outer margin of the pouch area and the outer edge of the pattern piece defines a skirt that covers a substantial portion of the gun stock, including the action.

In the preferred embodiment, the cover is multi-layer fabric, and comprises a first and a second fabric layer, both of the same external pattern shape with substantially identical margins. These two fabric layer pieces are disposed aligned back to back, one over the other, and sewn together adjacent a common, continuous external marginal edge. The casing is secured to at least one of the layers, preferably the top layer, by a generally oval line of sewing disposed spaced from the continuous external marginal edge to define the pouch area bounded by the casing sewing line. As in the first embodiment, the skirt area is defined between the pouch area and the common continuous external marginal edge. The casing stitches extend through at least one of the fabric layers to secure the casing to it along the line of sewing. The preferred casing is a strip of fabric folded over to form a sleeve large enough to receive the elastic cord. The preferred casing sleeve is a "double-fold"-type configuration; the two long edges are aligned facing inwardly of the sleeve and they are folded back over the aligned edges forming the first fold; the opposite side is creased, forming the second fold.

To form the pouch, a length of elastic cord having two ends is threaded in the casing and forms a loop that is disposed adjacent to and outwardly from the casing sewing line. The length of the elastic cord exceeds the perimeter length of the pouch margin. That is, the cord is longer than the casing sleeve in which it is threaded. There is a slit cut in at least one fabric layer and finished to form a "button hole", just outwardly of the pouch area boundary line of sewing so that both ends of the elastic cord extend out of the casing and through the button hole slit. The cords are secured together external of the slit. The elastic cord, upon being cinched and retained by the cord lock, forms an adjustably-sized pouch for engagement around the scope of a gun, with the skirt covering the gun action. The result is that the inventive cover is universal in size, light weight, air-permeable, quiet, easy to put on and take off and easy to store.

Some rifles, such as AR or HK-types, include an oval carry handle located on top of the barrel. Such handles are generally secured to the barrel or/and chamber flange by screws. In some case, the shooter removes the handle and replaces it with a scope. In other cases, scopes can be mounted on top of the handle. In either case, the pouch of the inventive scope and action cover fits over a scope mounted directly to the rifle, to a handle mounted directly to the rifle, or to a scope mounted on a rifle handle. Thus the inventive cover pouch is large enough to accommodate both handles and scopes, alone or in combination.

Cover pattern shape outlines may include, but are not limited to: oval, stadium, circle, kidney-shaped, irregular curvilinear bordered, or geometric (such as square, triangular, pentagonal, hexagonal, octagonal or rectangular) shapes. By way of example herein only, an oval cover pattern will be discussed in detail.

Cinching of the cover piece to form the scope-enveloping pouch is enabled by shortening a loop of elastic cord in the casing or lying between two layers of fabric, with both ends extending out a button hole/slit in the top fabric. The elastic cord may be in a casing disposed between the two layers of the cover. Alternately, the cord may be restrained by one or more oval line(s) of stitching medial between the outer margin of the cover and its center, the area defined centrally of the line(s) of stitching defining the pouch portion and becoming the pouch when the two ends of the cord are simultaneously pulled out the button hole/slit. This causes the pouch portion fabric to bunch and form the pouch. The cord can be confined between two parallel lines of stitching as an alternative to against one line or within a casing.

Thus, the line(s) of stitching or the casing define(s) the outer boundary of the pouch area, which boundary is medial between the center of the pattern and the outer marginal edge of the cover. The area between the line(s) of cord boundary stitching (the outer boundary of the pouch area) and the outer edge of the cover is defined as the skirt.

The pouch outer boundary stitching or casing is located on the order of from about 4 to about 6" inside the long sides outer edge of the oval fabric cover. That 4-6" or more medial area is called a flange or skirt. That is, when the cord is cinched, the medial material forms a somewhat gathered skirt that hangs below the scope to protect the gun's action from water, snow, ice, dust, sand and dirt, so that they drip down and off its edges. (Both the casing and its inner elastic is called, in the art and in this specification, an "elastic casing." Although neither the pouch material nor the casing itself is made of elastic fabric, it is the tunnel formed by the casing or the spaced double lines of stitching which borders the elastic, so that when cinched, it gathers the cover fabric to form a protective pouch). Another significant feature of the cover is that it shields the glass of the scope optics, both ends, so that there is no light reflection from them. Thus, when the inventive cover is installed over the scope, sunlight or artificial lights cannot be reflected off the glass causing a "flash" that will give away the presence and location of the shooter.

The cover is manufactured with an excess length of elastic cord fitted in, looped back on itself, and extending beyond the casing. The elastic cord exits through a button hole/slit in the top fabric layer and is secured by a spring-loaded cord lock or retainer member adjusted (by the gun user) to a length that creates a suitably-sized pouch. That is, by simply cinching, a universal pouch is created and sized in the field to best fit the scope and action or the particular gun being covered. The elastic cord is preferably an approximately ⅛"-¼" diameter, cotton- or polyester-wrapped round elastic cording material.

When the elastic is cinched over the scope in the field, the pouch forms a neck of diameter smaller than the length of the scope, and engages the underside of the ends of the scope, or one or more of the scope mounts. That is, there are forward and rear recessed areas between the gun barrel and the bottom of the scope. The elastic cinches into these recessed area beneath the gun scope, and between it and the top of the action and the barrel. In this manner, the pouch portion of the cover is securely retained around both sides, front and back of the scope that the weapon can be carried over the shoulder or even upside-down, and the cover will not fall off.

In an optional embodiment, to assist in preventing the skirt from shifting off the action while the gun is being held vertically or inverted, at least one set of hook and loop fastener strips are stitched to opposing faces of the skirt. These may be located toward the forward end of the pattern piece, to secure the skirt around the fore end of the gun (the barrel stock portion), and/or adjacent the hand grip (the neck between the butt and the trigger gard), or may be located at both ends, rendering the scope and action cover multi-directional. Multiple strips of hook and loop fastener are particularly useful for securing the cover around guns with or without scopes or handles, or guns of differing sizes. That is, a single cover may be switched from gun to gun.

In use, the hook side of hook and loop fastener (such as Velcro® brand hook and loop strips) can catch on clothing when it is exposed (i.e., when it is not fastened to the loop side). Releasing it, that is, pulling it off-of, or from, such fabrics makes a loud ripping sound that can startle game, particularly at night or in quiet or foggy conditions. To silence the hook strip when it is not in use, the inventive cover employs an extra, adjacent, "silencer" strip of loop fabric that is folded over the hook fastener strip and secured to it. This prevents accidental catching of hook strips on clothing that must then be loosened, or "ripped" off. The silencer loop strip covers the hook strip so it will not catch on anything else.

With respect to the universal features of the invention, when the user cinches the elastic cord to form a gathered pouch over the scope, handle or both, the elastic may be retained at a particular length, that is, an effective loop length, diameter or size, by the spring mechanism of the cord lock engaging the elastic at a chosen point. To further secure the spring lock, the elastic may then be knotted adjacent to the outer edge of the cord lock, and trimmed to establish a customized-fitting cover. One adjustment is all that is needed if the cover is to be used repeatedly with the same weapon. On the other hand, if the user has guns with scopes of varying lengths, the excess elastic need not be trimmed; it can be retained to allow for readjustment for each weapon, the knot being untied, the cord lock released and both being repositioned to provide an appropriately-sized gathered scope pouch.

To prevent the elastic from shifting inside the casing, or adjacent to a single line of stitching, or between double lines of stitching, the elastic is bar-tacked in place with a series of stitches running across the elastic and the casing at the end of the oval opposite the buttonhole and cord lock.

In its preferred embodiment, the elongated, generally oval-shaped pouch formed by the elastic casing is provided in three sizes to fit a wide range of standard-sized hand gun and rifle scopes. The majority of scopes (estimated at 90% of the scoped, gun market) are up to approximately 13-14" in length; an appropriately sized embodiment is referred to as size "Medium". Small (intended for up to approximately 7" length scopes), and Large (intended for scopes up to approximately 16-17" in length), models are also available. Because the elastic is adjustably cinchable, a cover of any size can be adjusted to fit on a scope smaller than the stated standard (by cinching the excess elastic and fabric to size), while a large scope will require a longer casing (a larger size inventive cover) to fit over it. For hand guns, the pattern piece is adjusted suitably smaller. Following the principles taught herein, special cover and pouch sizes can be made to order.

Regardless of the marked size (Small, Medium, Large) for hand guns and rifles, the inventive cover is made from a pattern piece that is a suitable geometric shape, roughly measuring 18"×24". The elastic casing width remains constant, creating a skirt in the range of approximately 2" to about 12" in width, preferably (for rifles) 4"-7" in width, distributed below the sides of the scope to fully cover the sides of the gun's action, while the casing length is shortened or lengthened to accommodate the different sized scope lengths.

It should be understood that the pattern piece size may be the same for all three sizes, the only difference being the size of the oval that creates the pouch area. Alternately, the pattern piece sizes can be different. In the case where a single pattern piece size is used, the skirt length at each end of the oval longitudinal axis is smaller than the side skirt length, but that is not a disadvantage, as the short end skirts tuck under the scope ends while the longer side skirts cover the action, barrel and a portion of the butt stock.

To place the inventive cover on a scope and action, with the cord lock held in the user's hand, the opposite (forward) end of the pouch is hooked around the front (object lens) end of the scope; the cover is gently pulled back, elongating the elastic oval, and the elastic forming the pouch is snapped around and underneath the eyepiece of the scope. With the cord lock located beneath the scope's eyepiece, the cover is perfectly positioned along the length of the scope to cover the action. Removing the cover is as simple—grasp the cord lock end of the elastic or cover, pull toward the user, stretching it to release the cover from the scope, then upward and forward enough to unhook it from beneath the front of the scope end.

As to materials of manufacture, in its preferred embodiment, the inventive cover is made of two main pattern pieces (A, outer layer, and B, inner or lower layer). In the preferred embodiment, the pattern piece A is a polyester/cotton blend to which a double-fold casing is single stitched adjacent the first told to secure the casing to the outer layer pattern piece A. The pattern piece B is a two-ply, laminated or coated, waterproof/breathable fabric as the inner or lower layer, and the two pattern pieces are sewn together along the continuous outer marginal edge. An example of the pattern piece B fabric is a coated texturized nylon, such as Taslan® brand nylon, that is coated with a latex or polymeric water proofing compound to be waterproof and breathable (such as having a value of on the order of 120 cm in a Suter waterproof test, and a breathability index of over 500 upright and 1100 inverted). Any suitable coating to provide a desired degree of waterproofing or water resistance and breathability may be applied to such or equivalent fabric. The breathable waterproof coating side is inside, that is, pattern piece B is oriented with the waterproof coating facing the upper pattern piece A's bottom (inner) face.

In an alternate embodiment wherein the waterproof layer is switched with the outer layer, that is, oriented as the upper layer, pattern piece A is a trilaminate (three-layer) fabric comprised of a two-way water resistant/breathable fabric (such as Gore-Tex®, XCR™, Entrant or Xalt) secured to an outer layer of woven polyester/cotton blended fabric, and an inner layer of soft, polyester/cotton blended woven or tricot knit fabric. The trilaminate "sandwich" protects the waterproof, breathable fabric coating(s) from both abrasion from the outside in use and abrasion from the inside due to the chafing of the elastic against it, both of which could reduce its air permeability and water resistance.

Pattern piece B, in this alternate embodiment, is a soft, woven polyester/cotton blend fabric which rests against the weapon and helps protect it from scratches and unwanted debris. Hence, in this alternate embodiment, the inventive cover is a four-layer structure in which three layers (forming pattern piece A) are laminated together, and a fourth (pattern piece B) is stitched to the trilaminate along the outer edge.

In either embodiment any combination of colors and patterns may be used. Thus, in the two layer preferred embodiment in which the lower layer B is a 2-ply coated fabric or the four-layer alternate embodiment, the outermost (face) layer of pattern piece A, which is exposed to the elements, is preferably provided in patterns designed for sportsmen (camouflage patterns in various shades of green, brown, beige, tan, sand, white, grey, blue and black). Alternately, safety coloring can be used, such as neon or blaze orange, yellow or chartreuse for high visibility. The face color of pattern piece B may be a safety color where another color is used for the face color of pattern piece A, a light color, such as sand, beige, white, light green, aqua, and the like, or a dark color such as black, dark (midnight) blue, dark brown, forest green, or charcoal.

With respect to forming the elastic casing, in its preferred embodiment, a narrow strip of bias-cut fabric is folded over to form a tunnel (or casing), and stitched to the back side of pattern piece A along an oval shape located approximately 4-6 inches in from the outer edge. This tunnel forms the elastic casing that holds the elastic cord between these two main pattern pieces. In this case, the oval stitch line is visible only on pattern piece A. As disclosed above, the casing can be either single or double fold. In an alternate embodiment, a "casing" or tunnel for the elastic is formed by stitching together pattern pieces A and B in two parallel ovals, a ½" space between which forms the casing through which the elastic runs. In this case, the double row of stitching is visible on both pattern pieces A and B. This embodiment is suitable for use with the trilaminate-using alternate embodiment. A sleeve type fabric casing is preferred in order to prevent chafing away of the waterproof coating on the inner fabric face. It is also preferred to not stitch through the waterproofing layer, as needle holes permit leakage of water.

Soft fabrics are selected as the preferred embodiment for both pattern piece A (or its face layer in the case of the trilaminate) and for pattern piece B (or its exterior face in the case of the preferred 2-ply coated embodiment), because noiselessness is desirable during hunting, and many waterproof fabrics tend to produce noises which can catch the attention of game. The latex coating, being interior of the cover "sandwich" and by its nature is quiet. The sandwiched middle layer of water resistant or water proof/breathable fabric in the trilaminate embodiment serves to protect the weapon from the elements (particularly precipitation and condensation), while the laminated, soft outer cover renders it quiet. The choice of soft fabrics also makes the inventive cover easy to wad or roll up to store in a pocket or a case.

Waterproof/breathable 2-ply coated fabric is selected for the preferred embodiment because in addition to the various modes of precipitation from which the scope must be shielded, describe above, humid conditions can cause the optics of a scope to fog. The breathable/air-permeable fabric allows air to circulate through the inventive cover fabric in both directions, so that excess water vapor will not remain trapped inside the cover to deposit onto the optical glass.

The inventive cover can be made in a variety of colors to help the hunter blend into the chosen hunting environment, and the layers can be selected from: a) Light colors, such as white, light green, beige or sand; b) dark colors, such as black, midnight blue, dark brown, dark charcoal or forest green; c) traditional or new camouflage patterns; or d) safety colors including blaze orange, chartreuse or neon yellow.

The first step in fabricating the preferred embodiment of the inventive scope and action cover is to locate and stitch the buttonhole (slit) through pattern piece A, and attach the elastic casing along the oval "track". The elastic is threaded through the buttonhole, around and through the inside of the casing and back out through the same buttonhole. Two lines of bar-tack stitching are applied, one at each longitudinal end of the casing "oval", from the boundary of the pouch to the outer marginal edge. This stitching passes through both layers, securing them together at that location to prevent the two layers from separating, sucking air through the slit and staying in a disorganized, "inflated" form when the cover is removed from the scope.

(If the alternate double-stitched elastic cord casing embodiment is selected, this is stitched through both layers to form a ½" wide, double-stitched, oval elastic casing medial of the outer continuous external edge margin of the pattern piece.)

Then, the two layers are stitched together along the outer marginal edge. The inner layer (back side) of the pattern piece A (polyester/cotton single-ply or trilaminate) is overlain onto pattern piece B, facing the wrong (back) side (or coated side of the 2-ply waterproof fabric) of that pattern piece B, and the two pattern pieces are bound together around their outer edges using double fold bias binding or a dense overlock stitch. Both elastic ends are then threaded into the hole in the cord lock, leaving two 2"-6" lengths of excess elastic, to allow for adjustment by the end user. In all, each cover contains on the order of 40" of elastic (35-45").

In the first alternate embodiment, the outer layer of trilaminate pattern piece A is a camouflage fabric, and pattern piece B is a blaze orange safety fabric, resulting in a universal, reversible scope and action cover, useful in different hunting conditions. Because in this embodiment, both Layers A and B act as the "outer" layer, when respectively reversed to be on the outside, buttonholes are stitched into both Layer A and Layer B and aligned one on top of the other before stitching the elastic casing. This permits the elastic and cord lock to be threaded out through either side of the inventive cover, for access to the elastic draw cord from either side of the cover.

The inventive cover, in any of its embodiments, may be offered with a small piece of absorbent foam threaded onto the elastic and stuffed through the button hole, before the cord lock is threaded on, to insure that when cinched, the buttonhole opening is sealed from the elements by the flexible foam.

In its broadest aspect the inventive cover is fabricated using two layers of single-ply fabric, at least one of which is water resistant or water repellant (e.g., treated with a water-repellant spray-on composition), as pattern pieces A and B, provided with the elastic casing and stitched together along the outer margin. This embodiment provides a less expensive reversible model, requiring buttonholes in both layers, and may provide adequate breathability and noiselessness for many conditions. (Of course, a waterproof/breathable, coated, 2-ply fabric is used in place of one of the single-ply fabric layers in the preferred embodiment.) As needed, water resistance can be imparted to one or both of the two single-ply layers of the cover by use of conventional spray-on silicone water repellant. In addition, in all embodiments, the exposed stitch lines and needle holes can be sprayed with water repellant to assist in reducing leakage, particularly in embodiments using two layers of single-ply fabric and on the bar-tack and casing sewing lines, particularly in the embodiments in which the casing is formed from the spaced parallel lines of sewing passing through both layers of fabric.

A third alternate embodiment is fabricated using a single layer of waterproofed or water resistant fabric as pattern piece A, and a smaller "crown" pattern piece for pattern piece B, which, when turned under for stitching along its outer margin, is large enough to extend only as far as the stitch line(s) of the elastic casing. Thus, this embodiment is not fully lined in the skirt area. Rather, pattern piece B is large enough only to create the casing and provide lining for the scope pouch. The edge of pattern piece A may be hemmed, bias bound, or finished with an over-lock (serge) stitch. In this alternate embodiment, the pattern piece B is preferably the waterproofed, 2-ply fabric oriented with the waterproof coating concealed, that is, facing the bottom of pattern piece A, and a tubular casing structure is used. The pattern piece A can be treated, at least in the skirt area, with water repellant compounds, e.g., spray-on type silicone fabric treatment material.

In a fourth, very basic, alternate embodiment the inventive cover is made from a single layer of waterproof or water resistant fabric (which may be the 2-ply material described above), as in the second embodiment, but utilizes a folded piece of bias-cut fabric or pre-made bias tape to form the single- or double-fold elastic casing tunnel. In this case, neither the crown (pouch) nor the skirt is lined. The outer edge of pattern piece A may be finished using any of the methods cited in the third alternate embodiment. The fabric can be spray treated for water repellency.

In a fifth alternate embodiment, any of the embodiments described above may include an inner pocket in the skirt area, sized to hold a "pocket warmer" disposable heat pack, to provide heat under the inventive cover, preventing ice from forming on the optics or metal, for from about 5- to about 12 hours. This pocket may be closed with hook and loop fastener, a zipper or a flap covering.

To enhance the camouflaging nature of the inventive scope and action cover, ghillie strips (also spelled "gillie", "ghilley", or other variants) may be provided. These strips (which may be made, for example, of yarn, cord, ribbon, or fabric strips, or of strips or pieces of natural materials, such as grass, leaves, reeds, bark and the like) are tied to (or slipped underneath) a lengthwise cord tacked to the outside surface of the cover. They hang on or below the edges of the skirt, provide a shaggy appearance that breaks up the outline to help the shooter and his equipment blend into their surroundings.

BRIEF DESCRIPTION OF THE DRAWINGS

The invention is described in detail by reference to the drawings, some of which are electronic photographs of an actual, full sized prototype of the inventive scope and action cover in which.

DETAILED DESCRIPTION, INCLUDING THE BEST MODES OF CARRYING OUT THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications, patents and applications cited in this specification are herein incorporated by reference as if each individual publication, patent or application had been expressly stated to be incorporated by reference.

The Figures are numbered so that one skilled in the arts of sewing and familiar with the shapes and sizes of gun scopes and actions will easily be able to understand the materials and method of construction and will be able to easily assemble the parts to achieve the functionality shown. In this connection, note that this simple design can easily be customized to provide protection for any sized scope on any sized gun.

The foregoing embodiments are to be considered illustrative rather than restrictive of the invention and those modifications which come within the meaning and range of equivalents of the description and claims are to be included therein.

Figure 1:
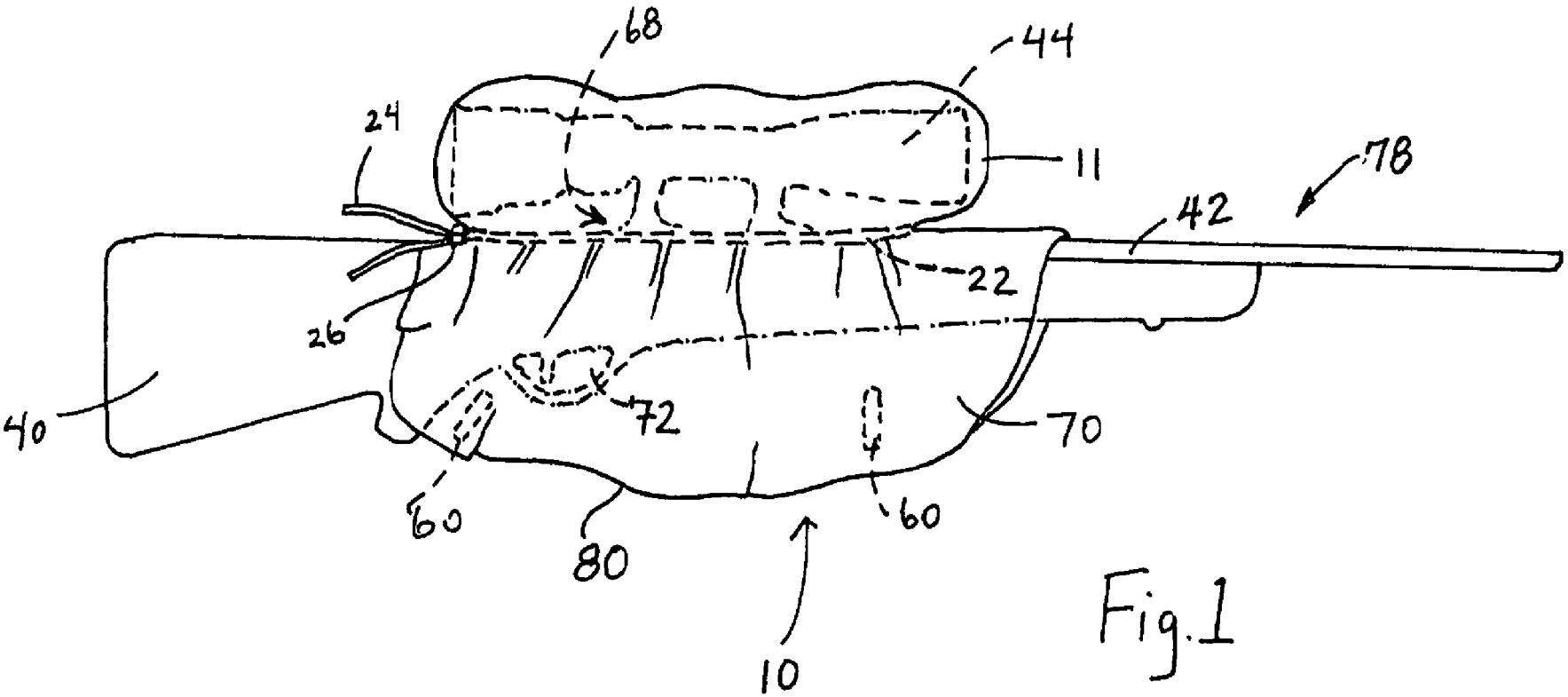
FIG. 1 is side elevation view of the inventive cover in use mounted over a scope and action, shown in dashed lines underneath the inventive cover.

FIG. 1 shows the inventive scope and action cover lOin use,mounted over a gun scope 44, with the cord lock 26 holding the elastic cord 24 at the eyepiece end of scope 44 on gun 78. Note that the gathered casing 22 of the inventive scope and action cover conforms to the recessed area 68 underneath gun scope 44 (best seen in FIG. 2) to form scope pouch 11. The skirt portion 70 of the inventive scope and action cover 10 drapes over the action mechanism 72 of the gun 78. Lengths of hook and loop fastener 60 are stitched on either side and of the forward and rear portions of the skirt to allow the sides of the cover to be attached to one another beneath the action mechanism 72 or/and the forward stock and barrel 42 4.

It is preferred that, the loop side of the fastener is stitched to the outer face of the cover, while the hook side is stitched to the inner face of the cover, so that when fastened, the selected surface, e.g., camouflage or safety color, is overlapped and therefore continuous on the outer (exposed to the elements) face. However, the hook can be fastened to one side of the inner face of the cover while the loop side fastened to the co-operatingly aligned opposite location so that the cover pinches together beneath the action and fore-stock rather than overlaps as in the preferred embodiment described just above.

Figure 2:
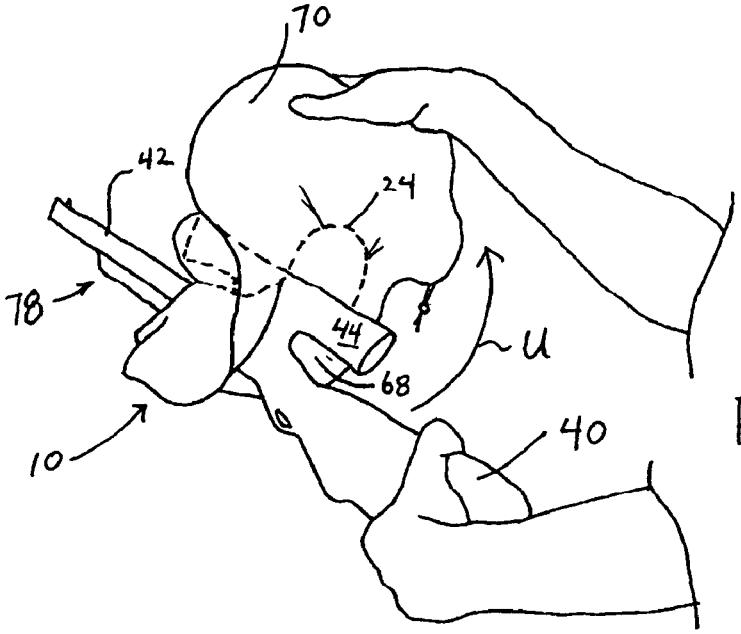
FIG. 2 is an isometric view from the butt end of the gun showing a user's hand grasping the inventive cover to remove it.

FIG. 2 shows the one-handed quick-release feature of the inventive, universal, silent scope and action cover 10. The user is shown grasping with the right hand the edge of the cover skirt 70 at the gun stock 40 end of the cover, closest to the user. He/she pulls the cover toward the gun stock 40 to release the cinched/locked cord from under the eyepiece of the scope, and then upward, in the direction of arrow U. Once the cover has cleared the eyepiece end of the gun scope 44, the user allows the elastic 24 of the cover 10 to naturally pull forward until it unhooks from the recessed area 68 beneath the eyepiece end of the scope adjacent the barrel 42. The scope and action cover 10 can then be folded or wadded up and stored in a pocket until it is needed again.

Figure 3:
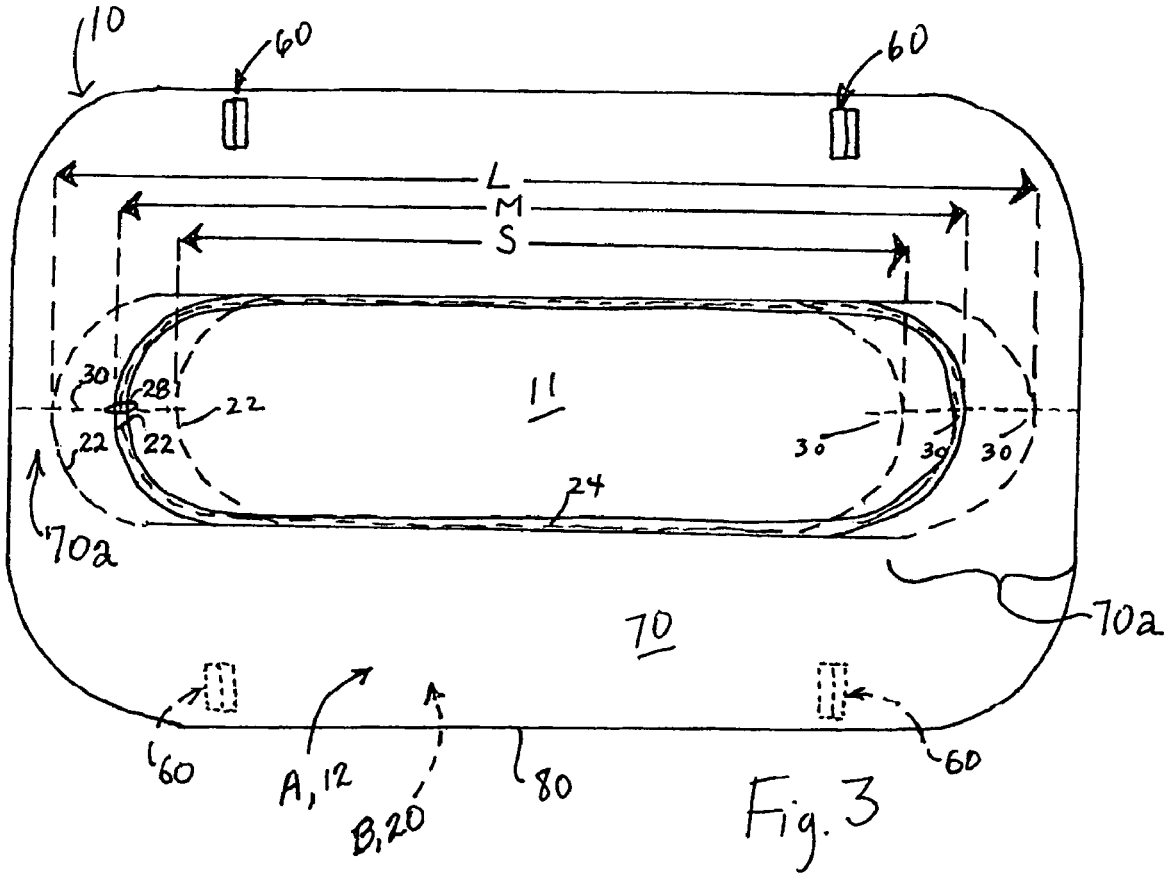
FIG. 3 is plan view of the flattened inventive cover, showing how the casing length is changed to produce three different sized covers (Small. Medium, Large) in a single pattern piece, and the hook and loop fasteners and silencing flaps.

FIG. 3 is a plan view showing the top, exterior surface of the inventive scope and action cover 10 in its flattened (ungathered) state, with the elastic cord 24 uncinched, releasing the pouch area 11 into a flat, geometric (in this drawing, stadium-shaped) configuration. Arrowed dimensions L, M and S indicate how the inventive pattern utilizes the same basic pattern pieces A, 12 (and B, 20; not visible), but alters the length of the elastic cord casing 22 to create sizes "Small" (S) to fit scopes of length up to approximately 7"; "Medium" (M) to fit scopes up to approximately 13-14"; and "Large" (L) for scopes up to approximately 16-17" in length.

Also visible is the bar-tack 30 line of sewing located at one or both ends of the oval 22 to keep the elastic 24 from slipping around inside the casing and the layers from coming apart. The Medium casing layout is shown in sold lines, the Large and Small are shown in dashed lines. Note the skirt area 70*a* at each end of the stadium or oval shaped pouch area 11 varies in size. Note also that the pattern can be described as generally rectangular with rounded corners, and the continuous marginal edge of the pattern piece is identified as item 80.

Figure 4A:
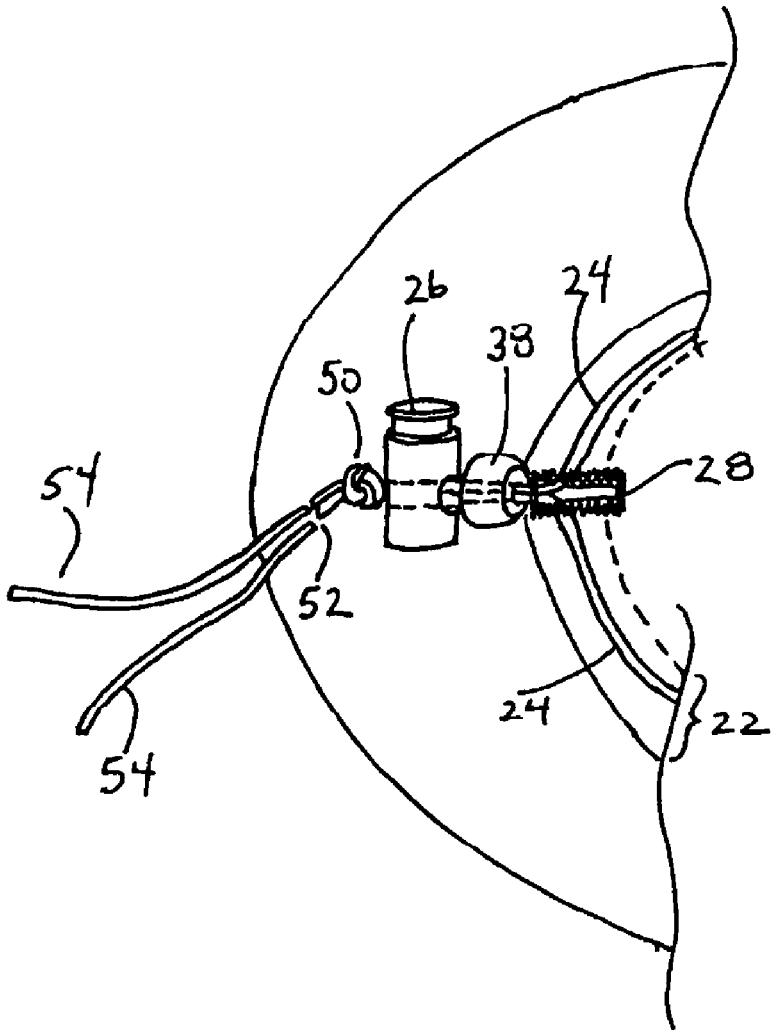
FIG. 4*a* is an enlarged isometric view of the elastic as it exits through the buttonhole, showing the optional foam pad, and the cord lock, knot and excess elastic length.

FIG. 4*a* is an enlarged isometric view of the elastic cord 24 emerging from the buttonhole 28, which is located at one end of the casing 22. Both ends of the round, approximately ⅛-¼"" diameter elastic 24 are threaded first through the optional foam sealer piece 38, which functions to seal the buttonhole 28 opening from precipitation during extreme conditions, and then through the cord lock 26. The foam can be either inside or outside the button hole. The inventive scope and action cover is provided with an excess length of elastic 54, on the order of 6" of the doubled cord as seen in FIG. 4*a*. When the customer purchases the cover and places it over the scope and action of a particular gun, he/she may choose to tie a knot 50 in the elastic cord 24 at a particular degree of gather, and trim the excess elastic cord at 52. Alternately, users may choose to leave the excess elastic 54 available for use with larger scopes which will require a longer length of elastic.

Figure 4B:
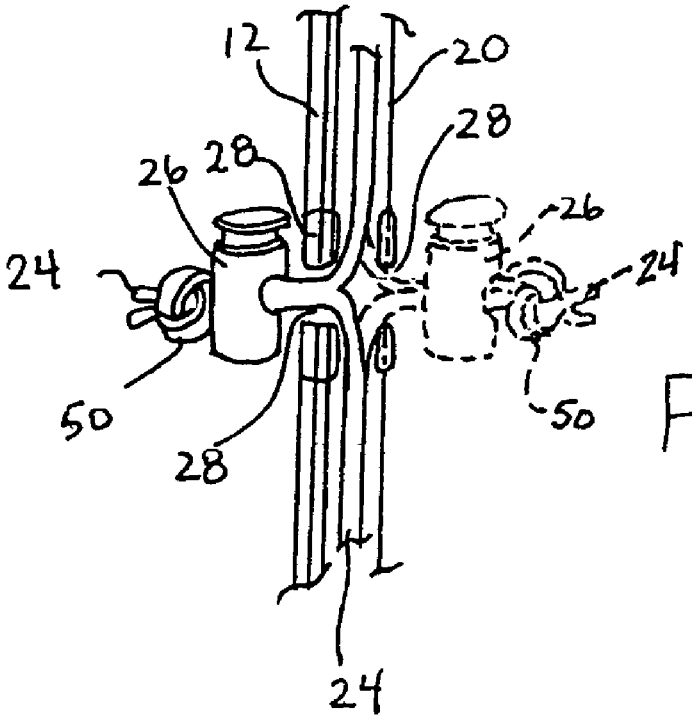
FIG. 4*b* is a section view of the casing in the first and second (reversible) alternative embodiments, showing how the aligned double buttonholes allow the draw cord and cord lock to exit on either side.

FIG. 4*b* is a section view of the reversible embodiments of the inventive scope and action cover 10, showing how aligned buttonholes 28 on both pattern pieces A, 12 and B, 20 allow the single length of elastic cord 24 to be drawn through the cord lock 26, and pulled alternately to one side or the other, depending upon whether the hunter desires to access it from face A (camouflauge, for example) or face B (blaze orange or black, for example). As shown, A is a trilaminate of the alternate embodiment, and B is a single layer. However, A can be a single layer and B the preferred 2-ply waterproofed Taslan® nylon fabric.

Figure 5A:
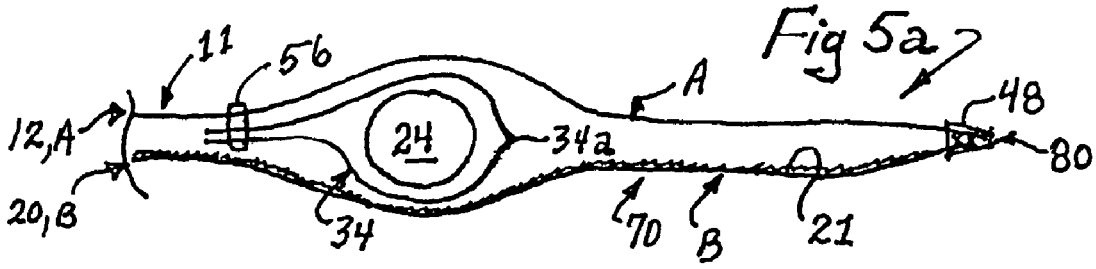
FIG. 5*a* is a cross section of the two layer preferred embodiment of pattern piece A in relation to a 2-ply, waterproof pattern piece B and the sleeve or tunnel-type casing of the inventive cover secured to pattern piece A.
Figure 5B:
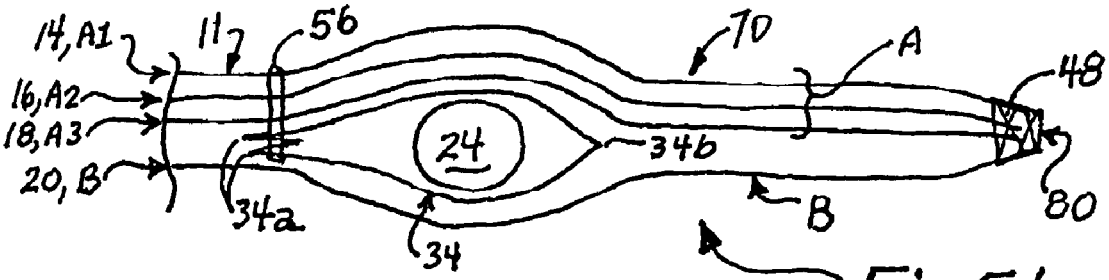
FIG. 5*b* is a cross-section of the alternate embodiment using a trilaminate for pattern piece A in relation to pattern piece B and the tunnel-type casing of the inventive scope and action cover.

FIG. 5*a* shows the preferred embodiment of a two layer cover assembly, the outer fabric pattern piece 12, A, being a single layer of polyester/cotton blend fabric, and pattern piece 20, B being a texturized Taslan® nylon fabric coated with a waterproof/breathable layer 21 to form a 2-ply layer. Note that the coating is on the inside to prevent abrasion from wearing through or off the waterproofing layer 21. The casing 34 contains the elastic cord 24 and comprises a strip or tape of fabric stitched at 56 to the outer (in this case, non-waterproofed) layer. In this example the casing is shown as a single-fold casing, the single fold identified as 34*a*; a double fold casing as shown in FIG. 5*b* can also be used. The casing divides the pouch area 11 from the skirt area 70. The outer marginal edge 80 is secured with a serged, over-lock stitch 48.

FIG. 5*b* shows in cross section the four-layer fabrication in the first alternate embodiment of the inventive scope and action cover 10. Layer A here is a trilaminate fabric sheet comprising an outer layer A-1, 14, of a woven, preferably polyester/cotton blend fabric printed with a sportsman's pattern, preferably camouflage. It is laminated to layer A2, 16, a waterproof or water resistant, two-way breathable middle layer (such as Gore-Tex®, XCR™, Entrant, Xalt or the like, material), which in turn, is laminated to an inner layer A3, 18, a woven or tricot knit polyester or polyester/cotton blend. Layers A1, 14, and A3, 18, protect middle layer A2, 16, from the abrasion of both the outside elements and the rubbing action of the elastic cord 24. The three layers, A1, A2 and A3 comprise the trilaminate, from which is cut Cover Layer Pattern Piece A, 12 (best seen in FIG. 3). Stitched to pattern piece A, 12 is Cover Layer Pattern Piece B, 20, made of a soft, preferably woven, polyester/cotton blend, or in the first alternate (reversible) embodiment of the invention, made of a sporting-patterned woven fabric (such as safety Blaze Orange). Round elastic cord 24 is held in a casing 22 formed by bias tape casing 34, which is stitched 56 either to the three trilaminate layers 14, 16 and 18, or to the inner, B layer (not shown). In this example, the casing is a double-fold construction, first fold 34*a* and second fold 34*b* being shown. In this view, the edges of pattern pieces A and B are edge finished with an over-edge, serge-type stitch 48. It should be understood that the trilaminate can be the inner layer, and the single layer can be the outer layer. That is, the orientation can be reversed with the layer shown as B being a camo outer layer, and the trilaminate 14, 16, 18 being an inner layer, in which case the casing 34 is stitched to the outer layer, as in FIG. 5*a*.

Figure 5C:
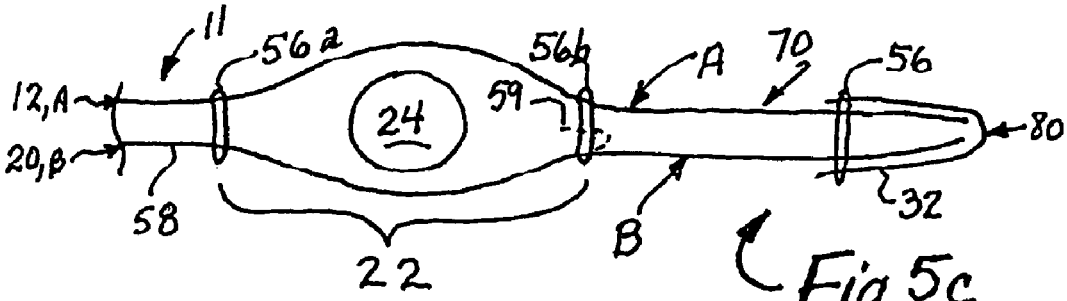
FIG. 5*c* is a cross-section drawing of a two layer construction showing pattern piece A in relation to pattern piece B and the double-stitched type casing of the inventive scope and action cover.

FIG. 5*c* shows a cross-section fabrication of a very basic, two-layer layer cover comprising single-layer pattern pieces A and B, but with a double stitched elastic cord casing 22 formed by stitch lines 56*a*, 56*b* located approximately ½" apart from each other and passing through both pattern pieces A and B, a distance of 4-6" (not drawn to scale) from the bias tape-trimmed edge 32 of the skirt margin 80. Note that the inner layer B may comprise only a pouch area or "crown" 58 that terminates at an infolded edge 59 that is stitched at 56*b*, the boundary with the skirt 70. See also FIG. 7*a*.

In each of FIGS. 5*a*-5*c* the stitching 56 defines the boundary between the pouch area 11 and the skirt area 70.

Figure 6A:
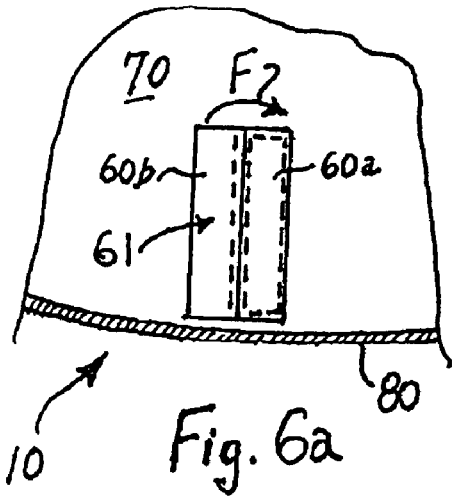
FIG. 6*a* is an enlarged plan view of the lateral version of the hook silencing flap.
Figure 6B:
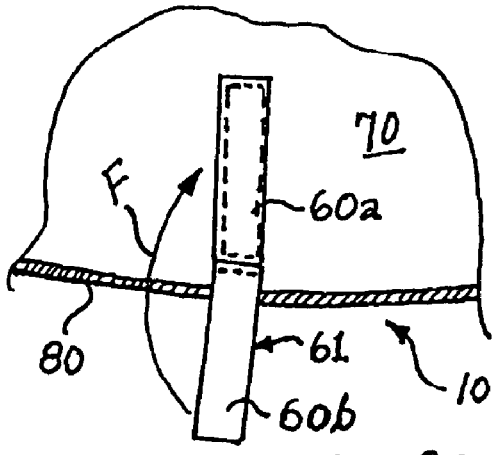
FIG. 6*b* is an enlarged view of the longitudinal version of the hook silencing flap.

FIGS. 6*a* and *b* show the hook silencer feature of the inventive scope and action cover. In FIG. 6*a*, hook fastener 60*a* is stitched onto scope and action cover 10. Next to it, along one long edge is stitched an equal length of loop fastener 60*b*, which functions as a silencer 61 when it is folded over onto hook 60*a* in the direction of the arrow F. In FIG. 6 *b*, hook fastener 60*a* is stitched onto scope and action cover 10. Below it, along one short edge is stitched an equal length of loop fastener 60*b*, which functions as a silencer 61 when it is folded upward onto hook 60*a* in the direction of the arrow F.

Figure 7A:
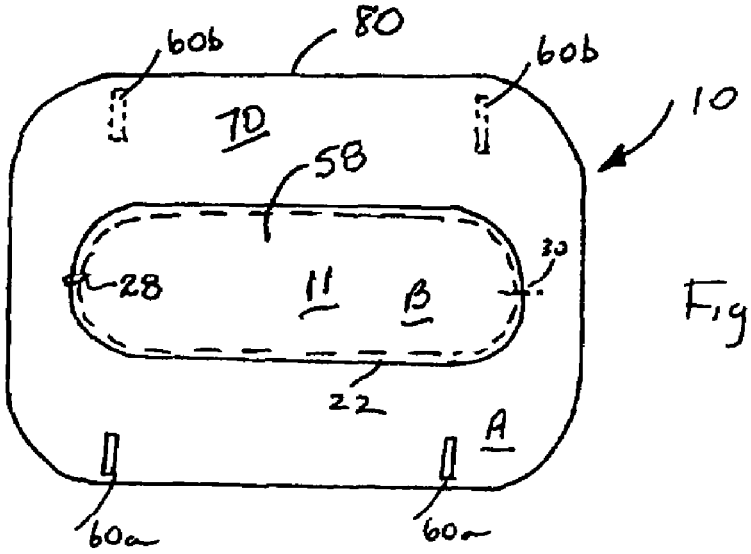
FIGS. 7*a*, 7*b* and 7*c* are plan views (seen from pattern piece B) of the third, fourth and fifth alternate embodiments.

FIG. 7*a* shows a third alternate embodiment, viewed from Side B. This embodiment uses a different-sized pattern piece B, 58, to form the scope pouch area 11. This smaller pattern piece 58 covers only the area defined by the outer perimeter of the pouch casing 34, here a double-stitch casing 22, see FIG. 5*c*. Note that the hook fasteners 60*a*, which connect together beneath the action mechanism of the gun 72 (not shown) are visible from the inner face (the B piece side) of the inventive cover, while the loop side 60*b* is shown in a dashed line, because it is sewn to the outer face of pattern piece A. There may be more than one pair of hook and loop tabs spaced along the skirt edge to provide a desired degree of skirt closure around the action, and they may be on the same face of the pattern piece A (or B where the pattern pieces are the same size and co-operatingly aligned to overlie each other in registration).

Figure 7B:
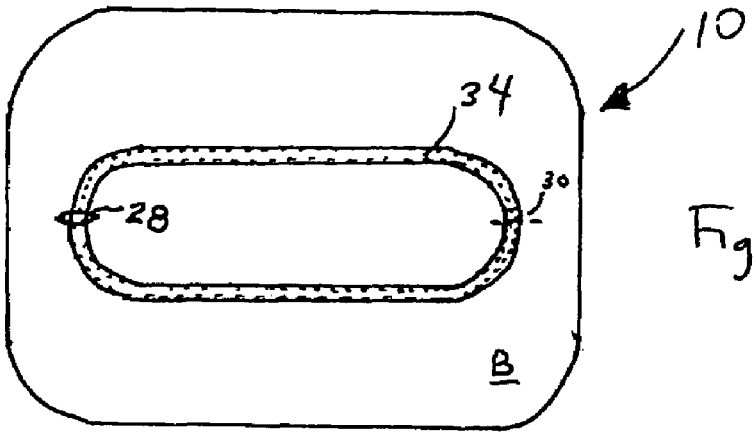

FIG. 7*b* shows a fourth alternate embodiment in which ⅜"-⅝" wide single fold bias tape is stitched along both of its edges to form elastic cord casing 22. In both FIGS. 7*a* and 7*b*, buttonhole 28 is stitched onto Layer A, 12, of the cover before the casing 22 is sewn. In all embodiments, bar-tack 30 is stitched through at least the layer to which the casing is sewn, and preferably all layers.

Figure 7C:
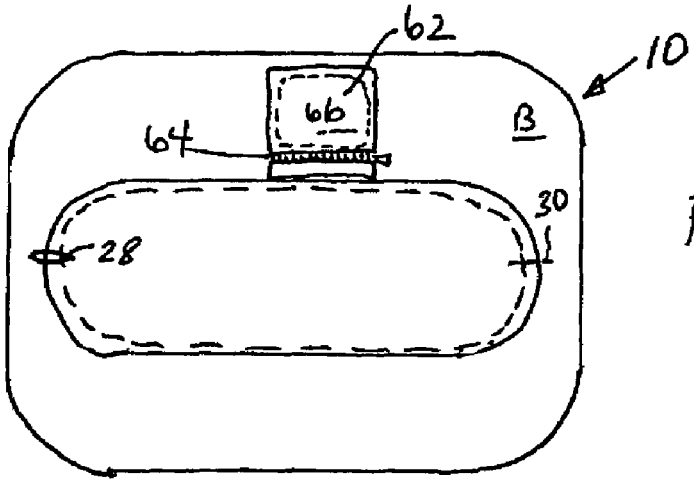

FIG. 7*c* shows how a pocket 62 can be stitched onto side B, 20 of the inventive cover to hold a disposable heat pack 66, when weather conditions warrant keeping the action mechanism of the gun 72 (or the hunter's hands) warmer than the outside temperature. The pocket is shown with a zipper 64 closure, but it should be understood that one skilled in the art can easily modify this for a hook and loop, snap, flap or other type of secure pocket closure system. In FIGS. 7*b* and 7*c* the barrel and action wrap closure hook and loop fasteners are not shown, as in some models of the cover such closures may not be required or desired.

Figure 8:
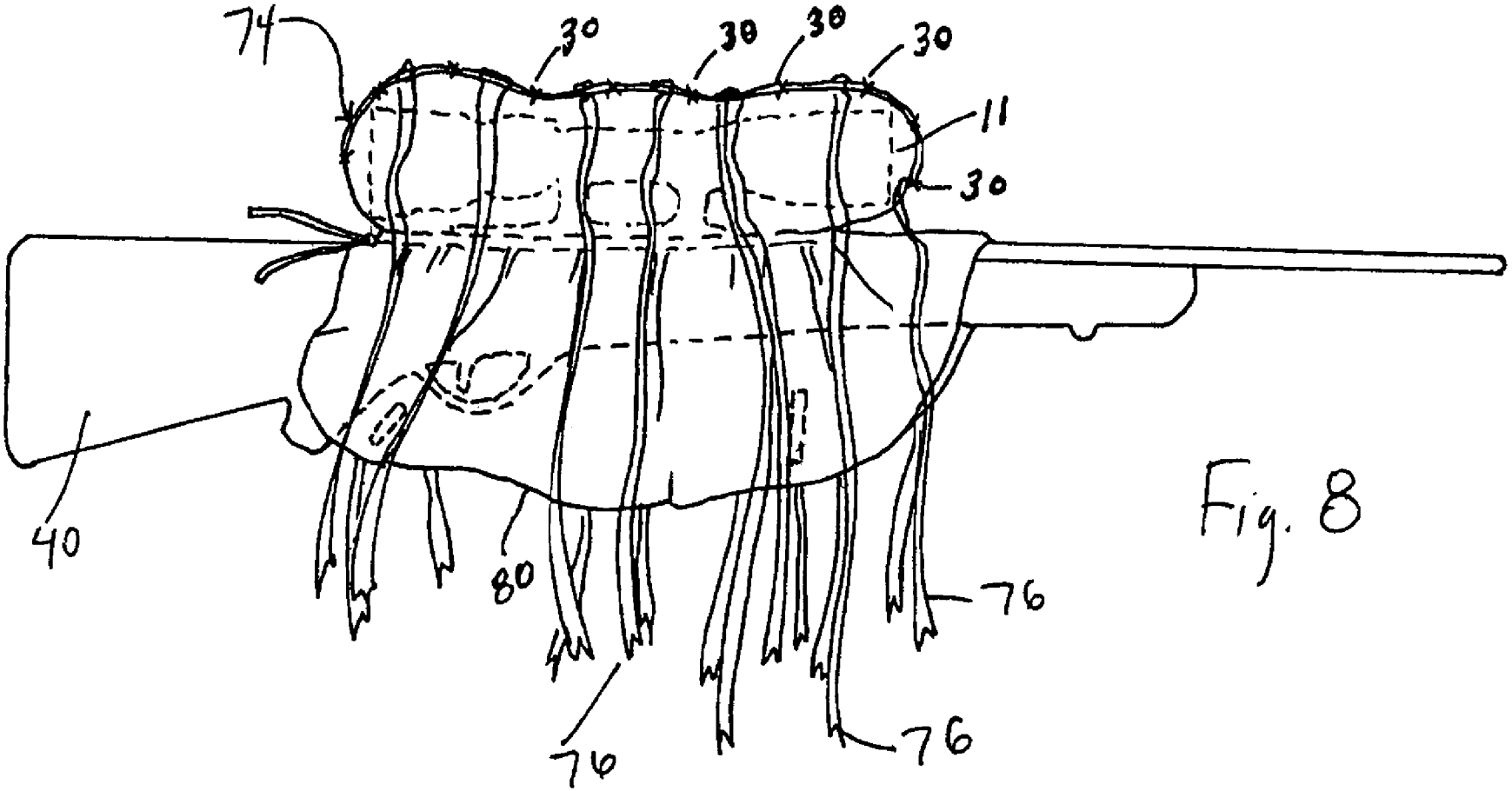
FIG. 8 is side elevation showing an alternate embodiment employing lengthwise tacked cord and hanging ghillie strips (not fully loaded with ghillie strips).

FIG. 8 shows inventive cover 10 in a similar elevation view as FIG. 1, with a cord 74 bar-tacked 30 along the length of the top of the pouch 11, that is, along the longitudinal axis of the stadium or oval shape of the pouch. The cord 74 may optionally extend out to the forward and back edges of the pattern piece (not shown), or may be confined to the skirt area only. Threaded underneath or tied around cord 74 are ghillie strips 76, generally in colors representative of the hunting environment or in camouflage patterned cloth, to create a shaggy, difficult to discern, form that will blend into its environment, to render the hunter less visible to prey. FIG. 8 shows only a few ghillie strips in place, it being understood that up to the entire cover can be completely covered with strips. In the alternative, the cord 74 can be bar-tacked just outside the stitch line on both sides of the scope that defines the pouch so that ghillie strips only cover the skirt area, not the pouch. Likewise, the ghillie strips shown can be shorter, to cover just the pouch area, or down to just short of the outer marginal edge 80 of the cover. When the ghillie strips get old and dirty, they can be a source of dust that can abrade or obscure the optics of the scope and action. Thus, reasonable care must be taken in use to insure the ghillie strips are confined to the exterior of the cover.

INDUSTRIAL APPLICABILITY

It is clear that the universal inventive scope and action cover has wide applicability to sport shooting, game hunting, police, security and military activities, namely to provide an inexpensive, universal, quiet, easily stowed, waterproof, abrasion resistant, breathable, quick-release, selectably reversible from camo to security colors, cover to protect optical scopes and action mechanisms, that can be fitted over a wide range of scope and gun sizes to protect from the weather, scuffing and scratching and against sound and optical reflection give-away.

It should be understood that various modifications within the scope of this invention can be made by one of ordinary skill in the art without departing from the spirit thereof and without undue experimentation. For example, the size and/or shape of the casing that forms the pouch can be modified to fit differences in specific scope length or diameter, or the skirt can be made wider to cover larger action mechanisms. One or more grommets can be placed near the outside edge for hanging up the cover to dry or for storage. Advances in fabric technology, including increased water resistance or waterproofing, breathability, laminating and bonding, will provide additional options for fabrication, shape, features and design of the cover. Fabric patterns may be chosen to either camouflage, or draw attention to, sportsmen for concealment or safety reasons in a variety of situations, including: traditional green, woods, leaves, brush, mountain or snow-scape camouflage to blend in with forest, mountain, plains or jungle in different seasons, or sand, tans and browns to blend into desert or bare topography. Those skilled in the art of patternmaking and sewing can easily recognize that there are a variety of methods that can be employed to customize the inventive cover, by utilizing a variety of fabrics, sewing and finishing techniques to create a cover that serves essentially the same purpose, and secures in essentially the same fashion as the inventive cover described herein.

The invention claimed is:

1. A universal scope and action protective cover for a gun having a barrel and an action mounted on a stock, and a scope mounted above said action and spaced from and parallel to said barrel so that both the front, object lens, and the eyepiece end of the scope include a recessed area, comprising in operative combination:

a) at least one layer of a waterproof, breathable, abrasion and precipitation resistant, highly flexible fabric configured to completely cover said scope and said action to protect them from adverse weather conditions, water, snow, ice, dust, sand, dirt and branches as a hunter moves through brush and to shield the glass of the scope optics, both ends, so that there is no light reflection, i. said fabric layer having an outer face, an inner face, and a generally oval, rectangular, rounded rectangular, or round shape bounded by a continuous external marginal edge, ii. said shape having a longitudinal length and a lateral width, iii. said length and width of the fabric layer being selected to provide complete coverage of said scope and said action as mounted on said stock, iv. said width being sufficient so that said marginal edge extends below said action when said fabric cover is emplaced to cover said scope;

b) a generally tubular drawstring casing structure associated with said fabric layer and defined by at least one generally rounded rectangular line of sewing, i. said drawstring casing being spaced from said fabric layer external marginal edge and defining a central, scope-covering rounded rectangular pouch area, ii. said defined central, scope-covering rounded rectangular pouch area having a length and width to provide complete coverage of said scope as mounted on said gun, iii. said length and width of said pouch area having an aspect ratio of about 2:1 to about 5:1, iv. upon being cinched to cover said scope said pouch area length being approximately 7 inches to approximately 17 inches, v. said drawstring casing defining a skirt area between said central scope-covering pouch area and said continuous external marginal edge, c) a length of elastic cord having two ends, i. said elastic cord being threaded in said tubular drawstring casing structure, said elastic cord and tubular drawstring casing structure together forming a rounded rectangular shaped loop cinch, ii. the length of said elastic cord exceeds the perimeter length of said casing that defines said scope-covering pouch area, d) a buttonhole structure having a slit opening cut in said at least one fabric layer communicating with said tubular drawstring casing so that both ends of said elastic cord extend out of said casing through said buttonhole slit, said cord ends being secured together external of said slit; and e) said scope and action cover structure in combination having the properties of being universal in size, light weight, waterproof, breathable, abrasion and precipitation resistant, quiet, and foldable for storage and said elastic cord permits one-handed emplacement of said pouch on and release from said gun scope and action.

2. A universal scope and action cover as in claim 1 which includes a first and a second fabric layer, both of the same external pattern shape with substantially identical margins, said fabric layers being disposed aligned back to back, one over the other, and sewn together adjacent a common, continuous external marginal edge.

3. A universal scope and action cover as in claim 2, wherein at least one of said fabric layers is selected from a 2-ply waterproof/breathable fabric layer and a trilaminate fabric layer that includes at least one water resistant or waterproof layer.

4. A universal scope and action cover as in claim 3 wherein:

a) said casing is formed from at least one of: i) a strip of material formed into a tube in which said cord is threaded, and ii) a pair of stitching lines spaced from each other and extending through both fabric layers to define a channel therebetween in which said cord is threaded;

b) said fabric layers are different in color or pattern selected from camouflage, a light color, a dark color, and a safety color, and said cords include a releasable, repositionable cinch lock device;

c) at least one of said fabric layers includes at least one pair of cooperatingly aligned hook and loop strips disposed adjacent said outer marginal edge to enable said skirt to be secured under at least one of the barrel of said gun or a portion of the stock of said gun, and a silencer for said hook strip comprising a strip of loop material secured adjacent to said hook strip and located and sized to cover and be secured to said hook strip when contacted therewith; and d) said cover includes at least one of provision to secure ghillie strips to at least a portion of one outer face of said fabric sheets and ghillie strips secured to at least a portion of one outer face of said fabric sheets.

5. A universal scope and action cover as in claim 2 wherein said fabric layers are different in color or pattern selected from camouflage, a light color, a dark color, and a safety color.

6. A universal scope and action cover as in claim 5 wherein one fabric layer includes an outer face that is a camouflage pattern and the other layer includes an outer face that is selected from a dark color and a safety color.

7. A universal scope and action cover as in claim 5 wherein said dark color is selected from black, dark blue, grey, dark brown and forest green, said light color is selected from white, sand, desert tan, pale green and light brown, and said safety color is selected from neon orange, yellow and chartreuse.

8. A universal scope and action cover as in claim 2 wherein said casing is formed from at least one of: a) a strip of material formed into a tube in which said cord is threaded, and b) a pair of stitching lines spaced from each other and extending through both fabric layers to define a channel therebetween in which said cord is threaded.

9. A universal scope and action cover as in claim 8 wherein said casing is said tube of material, the ends of which terminate at and are sewn to said fabric layer adjacent said buttonhole slit.

10. A universal scope and action cover as in claim 2 wherein said cords include a releasable, repositionable cinch lock device.

11. A universal scope and action cover as in claim 10 which includes a foam pad through which said elastic cord is threaded at the juncture of said casing with said buttonhole slit to assist in sealing said buttonhole against precipitation.

12. A universal scope and action cover as in claim 2 wherein at least one said fabric layers includes at least one pair of co-operatingly aligned hook and loop strips disposed adjacent said external marginal edge to enable said skirt to be secured under at least one of the barrel of said gun or a portion of the stock of said gun.

13. A universal scope and action cover as in claim 12 which includes a hook and loop silencer for said hook strip, comprising a strip of loop material secured adjacent to said hook strip and located and sized to cover and be secured to said hook strip when contacted therewith so that there is no chance for accidental adhesion of said hook strip to clothing, the release of which causes game-spooking ripping sounds.

14. A universal scope and action cover as in claim 2 wherein said fabric sheets are sized and said casing is located therein to provide at least two sizes including at least one of small, medium and large.

15. A universal scope and action cover as in claim 2 which includes a retaining member disposed secured to the exterior face of at least a portion of one of said fabric sheets to which ghillie strips can be engaged.

16. A universal scope and action cover as in claim 15 wherein said retaining member is at least one cord or strap disposed to bisect a portion of said fabric sheet pattern shape so that ghillie strips can be secured to hang down on both sides of said gun cover.

17. A universal scope and action cover as in claim 1 wherein said cover includes ghillie strips secured to at least a portion of one outer face of said fabric sheets.

18. A universal scope and action cover as in claim 1 which includes a pocket secured to one face of said at least one fabric layer in the area of said skirt, said pocket including a closure.

19. A universal scope and action cover as in claim 1 wherein; said casing is formed from at least one of:

a. a strip of material formed into a tube in which said cord is threaded, said tube being sewed to said fabric layer along said rounded rectangular line of sewing, and b. said cover includes a first and a second fabric layer disposed aligned back to back, one over the other, and sewn together adjacent a common, continuous external marginal edge, and said casing is formed between a pair of parallel stitching lines spaced from each other and extending through both fabric layers to define a channel therebetween in which said cord is threaded.

20. A universal scope and action cover as in claim 1 which includes a first and a second fabric layer, a first layer being larger and including a skirt area, and said second layer having an extent only sufficient to form said pouch area, said fabric layers being disposed aligned back to back, one over the other, and sewn together at said pouch rounded rectangular line of sewing.

* * * * *